US005828339A

United States Patent [19]

Patel

[11] Patent Number: 5,828,339

[45] Date of Patent: Oct. 27, 1998

[54] INTEGRATED DIRECTIONAL ANTENNA

[75] Inventor: Mineshkumar R. Patel, Middlesex, United Kingdom

[73] Assignee: DSC Communications Corporation, Plano, Tex.

[21] Appl. No.: 560,284

[22] Filed: Nov. 17, 1995

[30] Foreign Application Priority Data

Jun. 2, 1995 [GB] United Kingdom ..... 9511188

[51] Int. Cl.[6] ..... H01Q 1/38; H01Q 1/42

[52] U.S. Cl. ..... 343/700 MS; 343/789; 343/872

[58] Field of Search ..... 343/700 MS, 789, 343/872; H01Q 1/38, 1/42

[56] References Cited

U.S. PATENT DOCUMENTS

| | | | |
|---|---|---|---|
| 3,713,167 | 1/1973 | David | 343/789 |
| 4,218,685 | 8/1980 | Ellis, Jr. | 343/789 |
| 4,415,900 | 11/1983 | Kaloi | 343/700 MS |
| 4,737,975 | 4/1988 | Shafer | 379/58 |
| 4,763,324 | 8/1988 | Schwierz | 370/100 |
| 4,777,653 | 10/1988 | Bonnerot et al. | 455/69 |
| 4,801,934 | 1/1989 | Herkert | 340/825.02 |
| 4,864,565 | 9/1989 | Schuster et al. | 370/105.1 |
| 4,914,448 | 4/1990 | Otsuka et al. | 343/872 |
| 4,990,926 | 2/1991 | Otsuka et al. | 343/700 MS |
| 5,020,055 | 5/1991 | May, Jr. | 370/94.1 |
| 5,182,155 | 1/1993 | Roe | 428/116 |
| 5,189,674 | 2/1993 | Shimizu | 371/20.1 |
| 5,219,377 | 6/1993 | Poradish | 29/830 |
| 5,220,335 | 6/1993 | Huang | 343/700 MS |
| 5,237,586 | 8/1993 | Bottomley | 375/1 |
| 5,289,470 | 2/1994 | Chang et al. | 370/94.1 |
| 5,307,075 | 4/1994 | Huynh | 343/700 MS |
| 5,400,039 | 3/1995 | Araki et al. | 343/700 MS |
| 5,450,425 | 9/1995 | Gunn et al. | 371/67.1 |
| 5,539,415 | 7/1996 | Metzen et al. | 343/700 MS |
| 5,625,365 | 4/1997 | Tom et al. | 343/700 MS |
| 5,646,634 | 7/1997 | Bokhari et al. | 343/700 MS |

FOREIGN PATENT DOCUMENTS

| | | |
|---|---|---|
| 0097028 | 12/1983 | European Pat. Off. . |
| 0240821 | 10/1987 | European Pat. Off. . |
| 0364189 | 4/1990 | European Pat. Off. . |

(List continued on next page.)

OTHER PUBLICATIONS

IEEE Transactions on Antennas and Propagation, vol. 40, No. 5, Das, et al., "Multiport Scattering Analysis of General Multlayered Printed Antennas Fed by Multiple Feed Ports: Part II–Applications," May 1992, pp. 482–491.

From Pioneers of the 21st Century, Institute of Electrical and Electronics Engineers, Wagen, et al., "Time Dispersion Measurements Using a SSFIP Base Station Antenna," May 1992, pp. 5–8.

Digest of the Antennas and Propagation Society International Symposium, Seattle, WA, vol. 2, Jun. 1994, Institute of Electrical and Electronics Engineers, "Analysis of Single and Stacked Microstrip Patch Antennas Resideing in a Cavity by a Green's Function Technique," pp. 944–947.

International Search Report, dated Nov. 12, 1996, re:PCT/US96/08658, 7 pages.

*Primary Examiner*—Hoanganh T. Le

*Attorney, Agent, or Firm*—Baker & Botts, L.L.P.

[57] ABSTRACT

An integrated directional antenna includes a radome, a resonant cavity within the radome, a microstrip radiator and a patch re-radiator positioned within the resonant cavity to provide a directed or focused beam. A first radiator can be provided for signal transmission and a second radiator for signal reception. A chassis member is located within the radome and defines the resonant cavity/ies and a rear cavity for electronic components. A rear cover can incorporate an integral heat sink for dissipating heat from electronic components within the rear cavity. An antenna mounting bracket has first and second spaced mounting points to allow a large range of mounting angles with a compact construction. The chassis member, the radio transmission and/or receiving elements and the electronic circuit elements can be sandwiched together in a desired configuration by fixing the rear cover to the radome. The antenna finds particular application in the field of radio telephony systems.

25 Claims, 16 Drawing Sheets

FOREIGN PATENT DOCUMENTS

| | | | |
|---|---|---|---|
| 0529207 | 3/1993 | European Pat. Off. . | |
| 0565507 | 10/1993 | European Pat. Off. . | |
| 0582537 | 2/1994 | European Pat. Off. . | |
| 0642190 | 3/1995 | European Pat. Off. | H01Q 1/32 |
| 2710195 | 3/1995 | France | H01Q 23/00 |
| 2132454 | 7/1984 | United Kingdom . | |
| 2172775 | 9/1986 | United Kingdom . | |
| 2222504 | 3/1990 | United Kingdom . | |
| 2229320 | 9/1990 | United Kingdom . | |
| 2241851 | 9/1991 | United Kingdom . | |
| 2243267 | 10/1991 | United Kingdom . | |
| 2248007 | 3/1992 | United Kingdom . | |
| 2264375 | 8/1993 | United Kingdom . | |
| 2268293 | 1/1994 | United Kingdom . | |
| 2272610 | 5/1994 | United Kingdom . | |
| 2277425 | 10/1994 | United Kingdom . | |
| 2278260 | 11/1994 | United Kingdom . | |
| 2282510 | 4/1995 | United Kingdom . | |
| 2286317 | 8/1995 | United Kingdom . | |
| 2287379 | 9/1995 | United Kingdom . | |
| 8707408 | 12/1987 | WIPO . | |
| 8907377 | 8/1989 | WIPO . | |
| 9013962 | 11/1990 | WIPO . | |
| 9307702 | 4/1993 | WIPO . | |
| 9421057 | 9/1994 | WIPO . | |
| 9502950 | 1/1995 | WIPO . | |
| 9517785 | 6/1995 | WIPO . | |

FIG. 5A
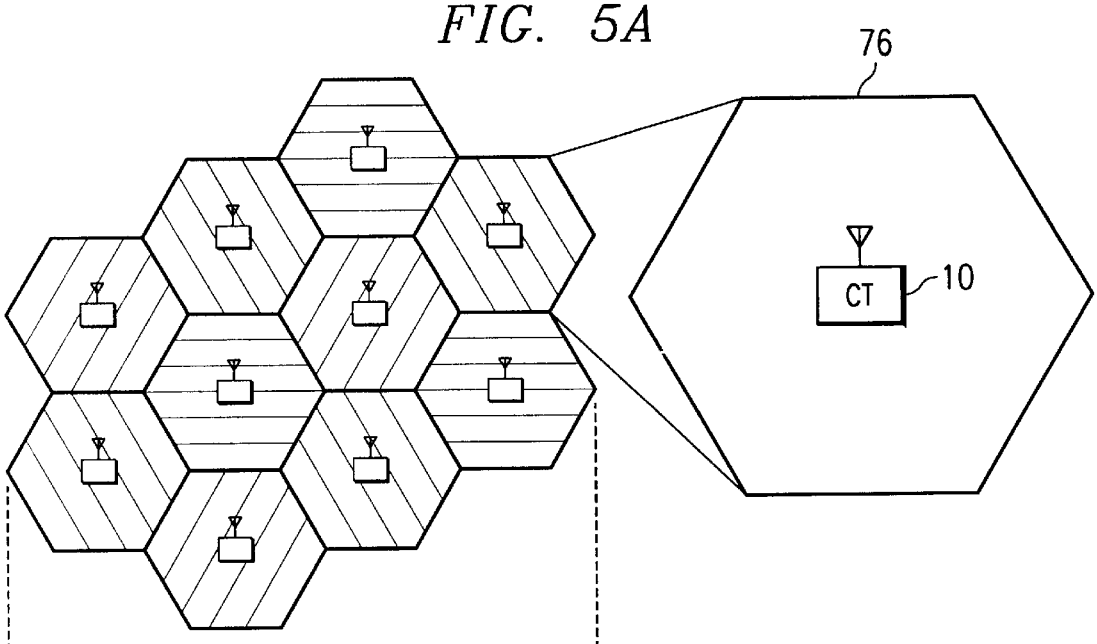
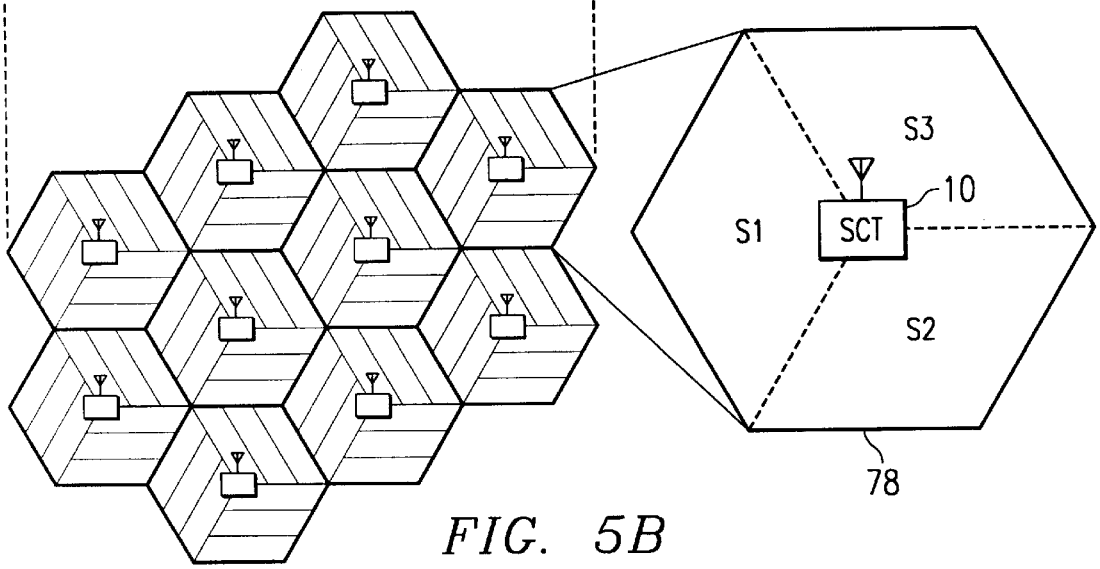
FIG. 5B

INTEGRATED DIRECTIONAL ANTENNA

TECHNICAL FIELD OF THE INVENTION

The present invention relates to an integrated directional antenna.

BACKGROUND OF THE INVENTION

It has been proposed to provide a radio telephone system where a plurality of fixed location subscriber terminals communicate with a fixed central terminal to provide radio telephone lines. In order that such a system is viable and attractive to potential customers, it is necessary that the radio equipment at the customer premises is inexpensive to purchase and operate, reliable and visually attractive.

SUMMARY OF THE INVENTION

In accordance with a first aspect of the present invention, therefore, there is provided an integrated directional antenna comprising a radome, means defining a resonant cavity within the radome, and a microstrip radiator and a patch re-radiator positioned within the resonant cavity to provide a directed or focused beam.

The use of an integrated antenna means that the antenna can be compact and visually attractive. It also means that components can be sealed in the antenna for increased reliability. Moreover, the use of a microstrip/patch radiator/re-radiator construction in combination with a resonant cavity results in a highly directional antenna for transmission and/or reception reducing losses due to beam spreading.

The resonant cavity can be used to adjust the 'Q' factor of the antenna, focusing the beam energy within desired operating frequencies. As a result, the signal strength on transmission can be kept low and the gain on reception can be kept high. It will be appreciated that the terms 'radiator' and 're-radiator' to describe the microstrip and patch combination, is intended to apply equally for transmission and reception.

The means for defining the resonant cavity can comprise a reflective rear wall substantially parallel to the microstrip and side walls around the microstrip.

Preferably, the radome is provided with means for locating the patch a predetermined distance in front of a ground plane of the microstrip. This enables the antenna to be tuned.

In a preferred embodiment of the invention, the radiator is a compound radiator comprising a single microstrip having a ground plane on a first side thereof with first and second coupling slots in the ground plane, the coupling slots being spaced from each other, and two re-radiator (reflector) patches, each located in front of a respective coupling slot. This enables increased performance to be achieved with small overall dimensions. The microstrip can be constructed with, on the side opposite to the ground plane, a long line RF feeder leading to an RF feeder strip for the two coupling slots.

Preferably, also, a first radiator for signal transmission and a second radiator for signal reception is provided. This enables simultaneous transmission and reception using respective radiators. As the transmission and reception frequencies will typically differ, the long line RF feeder on at least one microstrip can be provided with a tuning stub, for fine tuning.

Preferably, the antenna comprises a chassis member locatable within the radome, the chassis member having a rear wall with a rim projecting forwards from the wall to define a dished cavity. The chassis member can be made of plastics material with a metallised layer within the dished cavity for forming the resonant cavity.

Preferably, the radome and/or the chassis member are provided with formations permitting the selective location of alternative microstrip/patch combinations for accommodating different frequencies More particularly, the radome and the chassis member are provided with cooperating features for locating the microstrip at a predetermined distance in front of the rear wall.

Where separate transmitting and receiving radiators are provided, the chassis member and/or the radome preferably include a central wall for providing separate transmitter and receiver cavities.

Preferably, also, the chassis member has a further rim projecting rearwardly from the rear wall to define a rear cavity.

A metallised layer can also be provided within the rear cavity for electromagnetically shielding electronic components within the rear cavity.

A rear cover is preferably provided for closing the rear cavity.

In a preferred configuration, the fixing of the rear cover sandwiches the component parts of the antenna in a fixed spatial relationship within the radome. This reduces manufacturing costs by avoiding or reducing the need separately to secure components within the antenna.

The rear cover can typically be made at least partially of plastics material with a metallised layer thereon. Alternatively, the rear cover can be made at least partially of cast metal.

The rear cover can also incorporate an integral heat sink for dissipating heat from electronic components within the rear cavity.

Preferably, means can be provided for thermally coupling the electronic components within the antenna to the heat sink. Thermally conducting foam can be used for this process. However, such foam is expensive. More preferably, therefore, pedestals can be provided for thermally coupling the electronic components to the heatsink.

The antenna can be provided with an antenna mounting bracket, preferably integral to the rear cover.

Preferably, the antenna mounting bracket comprises first and second spaced mounting points, the mounting bracket being arranged to cooperate with a further mounting bracket for connection to a fixed support, the further mounting bracket being arranged to support the antenna mounting bracket at a selected one of the first and second mounting points for selecting a pivot point for rotating the antenna at a selected side of the antenna, thereby to provide a high angular range of mounting positions of the antenna to the fixed support.

In accordance with another aspect of the invention, there is provided an integrated directional antenna comprising a radome, a chassis member located within the radome and a rear cover, the chassis member defining a front cavity containing radio transmission and/or receiving elements and a rear cavity contain electronic circuitry, the rear cavity being electromagnetically shielded from the first cavity and from the outside of the integrated antenna by a metallic layer on or forming the chassis member and on or forming the rear cover.

In accordance with a further aspect of the invention, there is provided an integrated directional antenna comprising a radome, a chassis member located within the radome and separating a front cavity containing radio transmission and/or receiving elements from a rear cavity contain electronic circuit elements, and a rear cover, wherein the chassis member, the radio transmission and/or receiving elements and the electronic circuit elements are sandwiched together in a desired configuration by fixing the rear cover to the radome.

As mentioned above, the invention finds particular application to an integrated customer radio unit for a radio telephony system.

Preferably the antenna comprises a rear cavity containing RF circuitry and modem circuitry for the transmission and/or reception of telephony signals. By integrating this circuitry within the antenna, the additional circuitry within the subscriber's premises can be kept to a minimum.

A compact construction and high performance of the radio circuitry can be enhanced where each the microstrip comprises a stud which extends between the resonant cavity and the rear cavity for direct coupling of the radiator to the RF circuitry.

BRIEF DESCRIPTION OF THE DRAWINGS

Embodiments of the invention will be described hereinafter, by way of example only, with reference to the accompanying drawings in which like reference signs are used for like features and in which:

FIGS. 5A and 5B are schematic diagrams illustrating possible configurations for cells for the telecommunications system of FIG. 1;

DETAILED DESCRIPTION OF THE INVENTION

Figure 1:
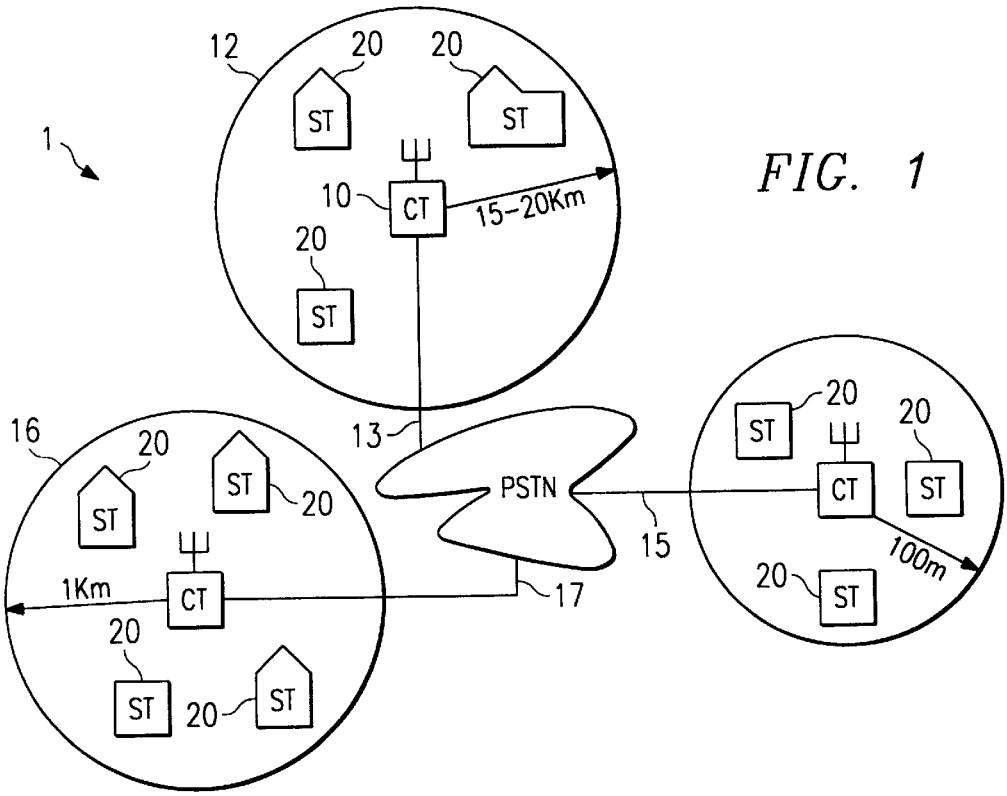
FIG. 1 is a schematic overview of an example of a wireless telecommunications system in which an example of the present invention is included.

FIG. 1 is a schematic overview of an example of a wireless telecommunications system. The telecommunications system includes one or more service areas 12, 14 and 16, each of which is served by a respective central terminal (CT) 10 which establishes a radio link with subscriber terminals (ST) 20 within the area concerned. The area which is covered by a central terminal 10 can vary. For example, in a rural area with a low density of subscribers, a service area 12 could cover an area with a radius of 15–20 Km. A service area 14 in an urban environment where is there is a high density of subscriber terminals 20 might only cover an area with a radius of the order of 100 m. In a suburban area with an intermediate density of subscriber terminals, a service area 16 might cover an area with a radius of the order of 1 Km. It will be appreciated that the area covered by a particular central terminal 10 can be chosen to suit the local requirements of expected or actual subscriber density, local geographic considerations, etc, and is not limited to the examples illustrated in FIG. 1. Moreover, the coverage need not be, and typically will not be circular in extent due to antenna design considerations, geographical factors, buildings and so on, which will affect the distribution of transmitted signals.

The central terminals 10 for respective service areas 12, 14, 16 can be connected to each other by means of links 13, 15 and 17 which interface, for example, with a public switched telephone network (PSTN) 18. The links can include conventional telecommunications technology using copper wires, optical fibres, satellites, microwaves, etc.

The wireless telecommunications system of FIG. 1 is based on providing fixed microwave links between subscriber terminals 20 at fixed locations within a service area (e.g., 12, 14, 16) and the central terminal 10 for that service area. In a preferred embodiment each subscriber terminal 20 is provided with a permanent fixed access link to its central terminal 10. However, in alternative embodiments demand-based access could be provided, so that the number of subscribers which can be serviced exceeds the number of telecommunications links which can currently be active.

Figure 2:
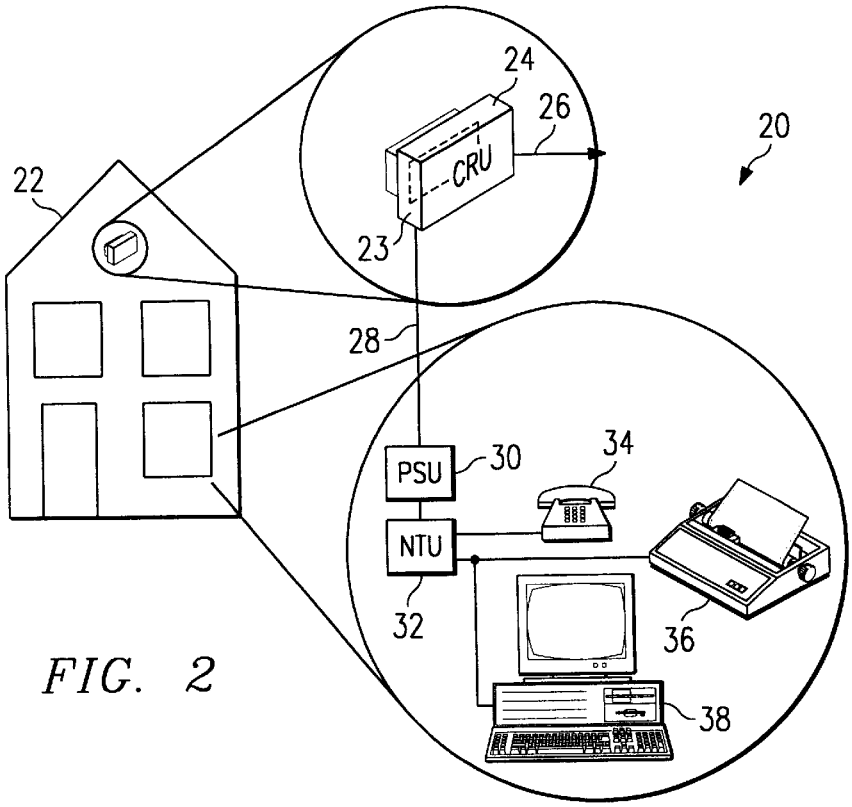
FIG. 2 is a schematic illustration of an example of a subscriber terminal of the telecommunications system of FIG. 1.

FIG. 2 illustrates an example of a configuration for a subscriber terminal 20 for the telecommunications system of FIG. 1. FIG. 2 includes a schematic representation of customer premises 22. A customer radio unit (CRU) 24 is mounted on the customer's premises. The customer radio unit 24 includes a flat panel antenna or the like 23. The customer radio unit is mounted at a location on the customer's premises, or on a mast, etc., and in an orientation such that the flat panel antenna 23 within the customer radio unit 24 faces in the direction 26 of the central terminal 10 for the service area in which the customer radio unit 24 is located.

The customer radio unit 24 is connected via a drop line 28 to a power supply unit (PSU) 30 within the customer's premises. The power supply unit 30 is connected to the local power supply for providing power to the customer radio unit 24 and a network terminal unit (NTU) 32. The customer radio unit 24 is also connected to via the power supply unit 30 to the network terminal unit 32, which in turn is connected to telecommunications equipment in the customer's premises, for example to one or more telephones 34, facsimile machines 36 and computers 38. The telecommunications equipment is represented as being within a single customer's premises. However, this need not be the case, as the subscriber terminal 20 preferably supports either a single or a dual line, so that two subscriber lines could be supported by a single subscriber terminal 20. The subscriber terminal 20 can also be arranged to support analogue and digital telecommunications, for example analogue communications at 16, 32 or 64 kbits/sec or digital communications in accordance with the ISDN BRA standard.

Figure 3:
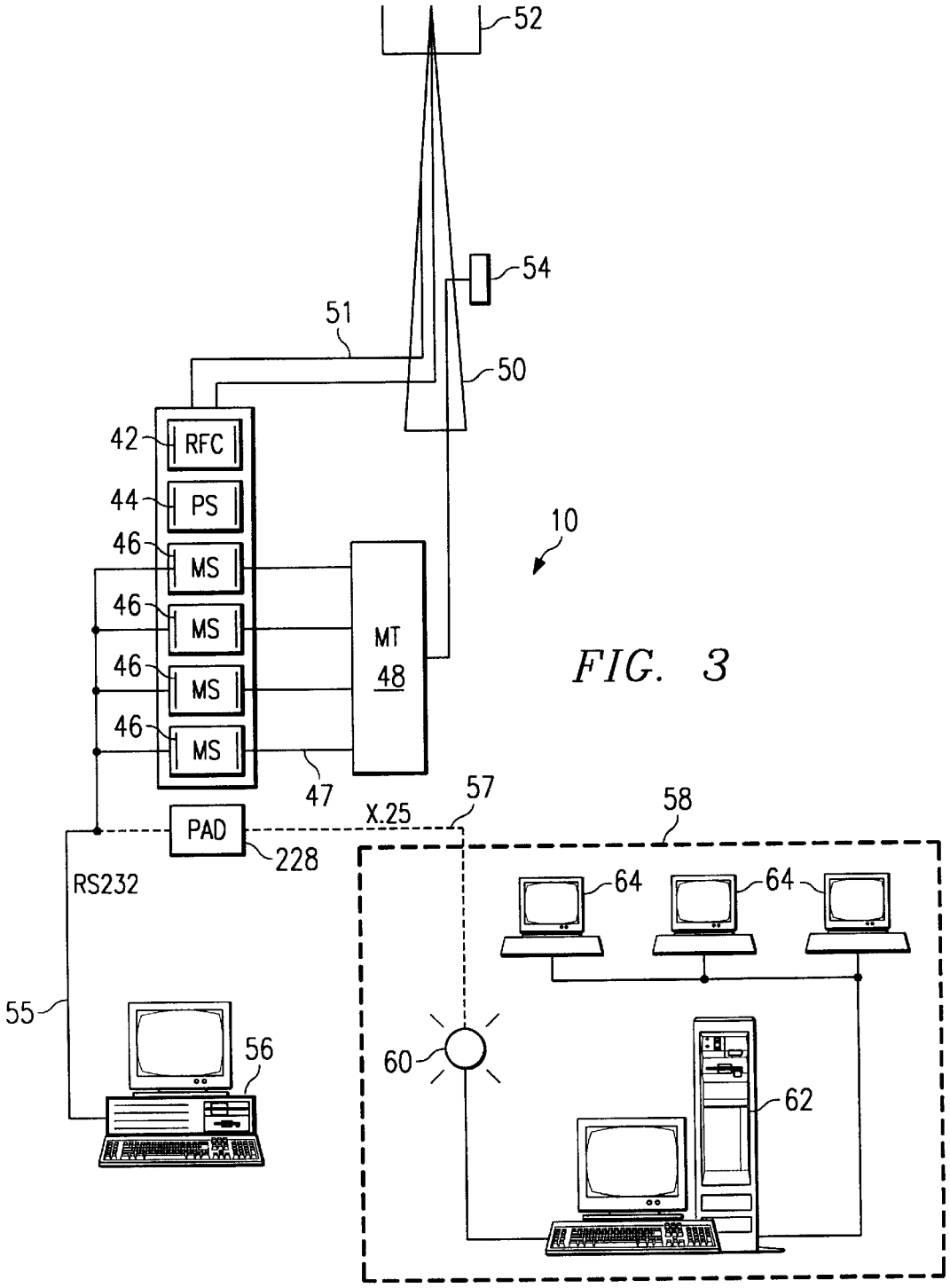
FIG. 3 is a schematic illustration of an example of a central terminal of the telecommunications system of FIG. 1.

FIG. 3 is a schematic illustration of an example of a central terminal of the telecommunications system of FIG. 1. The common equipment rack 40 comprises a number of equipment shelves 42, 44, 46, including a RF Combiner and power amp shelf (RFC) 42, a Power Supply shelf (PS) 44 and a number of (in this example four) Modem Shelves (MS) 46. The RF combiner shelf 42 allows the four modem shelves 46 to operate in parallel. It combines and amplifies the power of four transmit signals, each from a respective one of the four modem shelves, and amplifies and splits received signals four way so that separate signals may be passed to the respective modem shelves. The power supply shelf 44 provides a connection to the local power supply and fusing for the various components in the common equipment rack 40. A bidirectional connection extends between the RF combiner shelf 42 and the main central terminal antenna 52, typically an omnidirectional antenna, mounted on a central terminal mast 50.

This example of a central terminal 10 is connected via a point-to-point microwave link to a location where an interface to the public switched telephone network 18, shown schematically in FIG. 1, is made. As mentioned above, other types of connections (e.g., copper wires or optical fibres) can be used to link the central terminal 10 to the public switched telephone network 18. In this example the modem shelves are connected via lines 47 to a microwave terminal (MT) 48. A microwave link 49 extends from the microwave terminal 48 to a point-to-point microwave antenna 54 mounted on the mast 50 for a host connection to the public switched telephone network 18.

A personal computer, workstation or the like can be provided as a site controller (SC) 56 for supporting the central terminal 10. The site controller 56 can be connected to each modem shelf of the central terminal 10 via, for example, RS232 connections 55. The site controller 56 can then provide support functions such as the localization of faults, alarms and status and the configuring of the central terminal 10. A site controller 56 will typically support a single central terminal 10, although a plurality of site controllers 56 could be networked for supporting a plurality of central terminals 10.

As an alternative to the RS232 connections 55, which extend to a site controller 56, data connections such as an X.25 links 57 (shown with dashed lines in FIG. 3) could instead be provided from a pad 228 to a switching node 60 of an element manager (EM) 58. An element manager 58 can support a number of distributed central terminals 10 connected by respective connections to the switching node 60. The element manager 58 enables a potentially large number (e.g., up to, or more than 1000) of central terminals 10 to be integrated into a management network. The element manager 58 is based around a powerful workstation 62 and can include a number of computer terminals 64 for network engineers and control personnel.

Figure 3A:
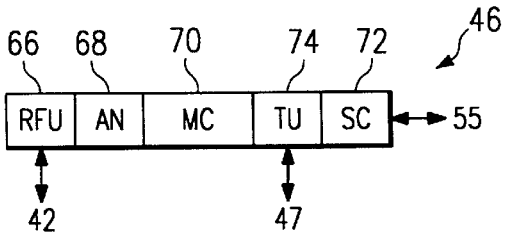
FIG. 3A is a schematic illustration of a modem shelf of a central terminal of the telecommunications system of FIG. 1.

FIG. 3A illustrates various parts of a modem shelf 46. A transmit/receive RF unit (RFU—for example implemented on a card in the modem shelf) 66 generates the modulated transmit RF signals at medium power levels and recovers and amplifies the baseband RF signals for the subscriber terminals. The RF unit 66 is connected to an analogue card (AN) 68 which performs A-D/D-A conversions, baseband filtering and the vector summation of 15 transmitted signals from the modem cards (MCs) 70. The analogue unit 68 is connected to a number of (typically 1–8) modem cards 70. The modem cards perform the baseband signal processing of the transmit and receive signals to/from the subscriber terminals 20. This includes ½ rate convolution coding and x 16 spreading with CDMA codes on the transmit signals, and synchronization recovery, despreading and error correction on the receive signals. Each modem card 70 in the present example has two modems, each modem supporting one subscriber link (or two lines) to a subscriber terminal 20. Thus, with two modems per card and 8 modems per modem shelf, each modem shelf could support 16 possible subscriber links. However, in order to incorporate redundancy so that a modem may be substituted in a subscriber link when a fault occurs, only up to 15 subscriber links are preferably supported by a single modem shelf 46. The 16th modem is then used as a spare which can be switched in if a failure of one of the other 15 modems occurs. The modem cards 70 are connected to the tributary unit (TU) 74 which terminates the connection to the host public switched telephone network 18 (e.g., via one of the lines 47) and handles the signaling of telephony information to, for example, up to 15 subscriber terminals (each via a respective one of 15 of the 16 modems).

Figure 4:
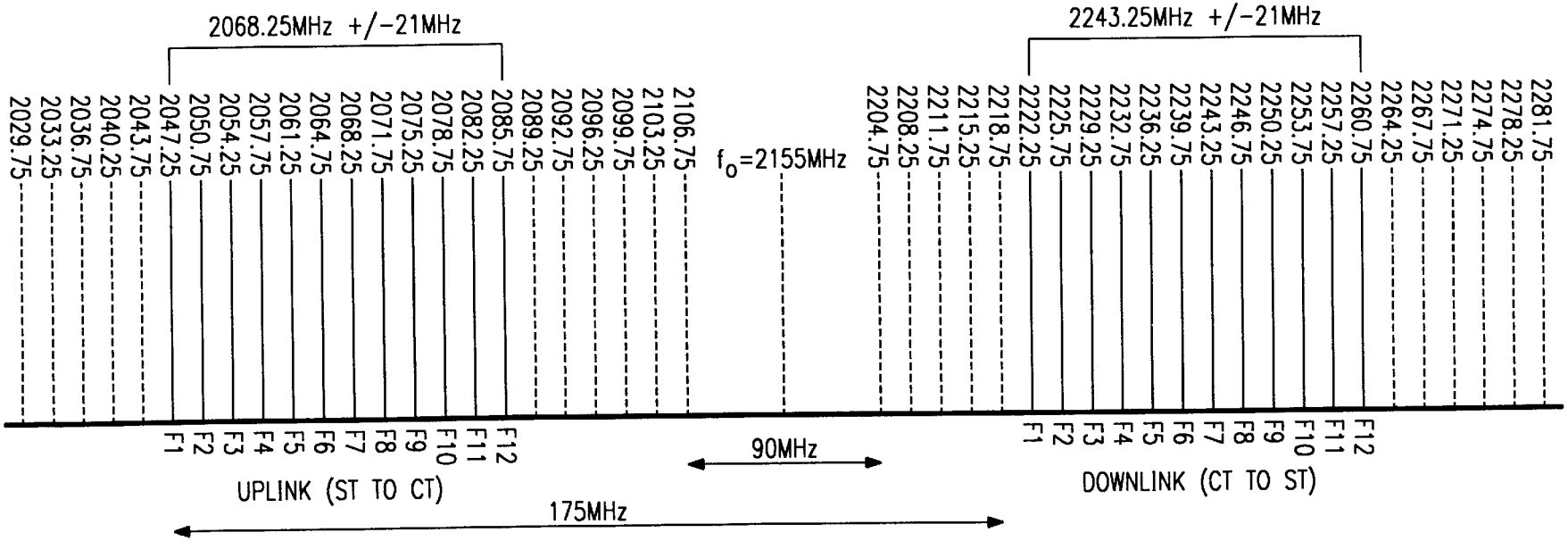
FIG. 4 is an illustration of an example of a frequency plan for the telecommunications system of FIG. 1.

The wireless telecommunications between a central terminal 10 and the subscriber terminals 20 could operate on various frequencies. FIG. 4 illustrates one possible example of the frequencies which could be used. In the present example, the wireless telecommunication system is intended to operate in the 1.5–2.5 GHz Band. In particular the present example is intended to operate in the Band defined by ITU-R (CCIR) Recommendation F.701 (2025–2110 MHz, 2200–2290 MHz). FIG. 4 illustrates the frequencies used for the uplink from the subscriber terminals 20 to the central terminal 10 and for the downlink from the central terminal 10 to the subscriber terminals 20. It will be noted that 12 uplink and 12 downlink radio channels of 3.5 MHz each are provided centred about 2155 MHz. The spacing between the receive and transmit channels exceeds the required minimum spacing of 70 MHz.

In the present example, as mentioned above, each modem shelf will support 1 frequency channel (i.e. one uplink frequency plus the corresponding downlink frequency). Up to 15 subscriber links may be supported on one frequency channel, as will be explained later. Thus, in the present embodiment, each central terminal 10 can support 60 links, or 120 lines.

Typically, the radio traffic from a particular central terminal 10 will extend into the area covered by a neighboring central terminal 10. To avoid, or at least to reduce interference problems caused by adjoining areas, only a limited number of the available frequencies will be used by any given central terminal 10.

FIG. 5A illustrates one cellular type arrangement of the frequencies to mitigate interference problems between adjacent central terminals 10. In the arrangement illustrated in FIG. 5A, the hatch lines for the cells 76 illustrate a frequency set (FS) for the cells. By selecting three frequency sets (e.g., where: FS1=F1, F4, F7, F10; FS2=F2, F5, F8, F11; FS3=F3, F6, F9, F12), and arranging that immediately adjacent cells do not use the same frequency set (see, for example, the arrangement shown in FIG. 5A), it is possible to provide an array of fixed assignment omnidirectional cells where interference between nearby cells can be avoided. The transmitter power of each central terminal 10 is set such that transmissions do not extend as far as the nearest cell which is using the same frequency set. Thus each central terminal 10 can use the four frequency pairs (for the uplink and downlink, respectively) within its cell, each modem shelf in the central terminal 10 being associated with a respective RF channel (channel frequency pair).

With each modem shelf supporting one channel frequency (with 15 subscriber links per channel frequency) and four modem shelves, each central terminal 10 will support 60 subscriber links (i.e., 120 lines). The 10 cell arrangement in FIG. 5A can therefore support up to 600 ISDN links or 1200 analogue lines, for example. FIG. 5B illustrates a cellular type arrangement employing sectored cells to mitigate problems between adjacent central terminals 10. As with FIG. 5A, the different type of hatch lines in FIG. 5B illustrate different frequency sets. As in FIG. 5A, FIG. 5B represents three frequency sets (e.g., where: FS1=F1, F4, F7, F10; FS2=F2, F5, F8, F11; FS3=F3, F6, F9, F12). However, in FIG. 5B the cells are sectored by using a sectored central terminal (SCT) 13 which includes three central terminals 10, one for each sector S1, S2 and S3, with the transmissions for each of the three central terminals 10 being directed to the appropriate sector among S1, S2 and S3. This enables the number of subscribers per cell to be increased three fold, while still providing permanent fixed access for each subscriber terminal 20.

A seven cell repeat pattern is used such that for a cell operating on a given frequency, all six adjacent cells operating on the same frequency are allowed unique PN codes. This prevents adjacent cells from inadvertently decoding data.

Figure 6:
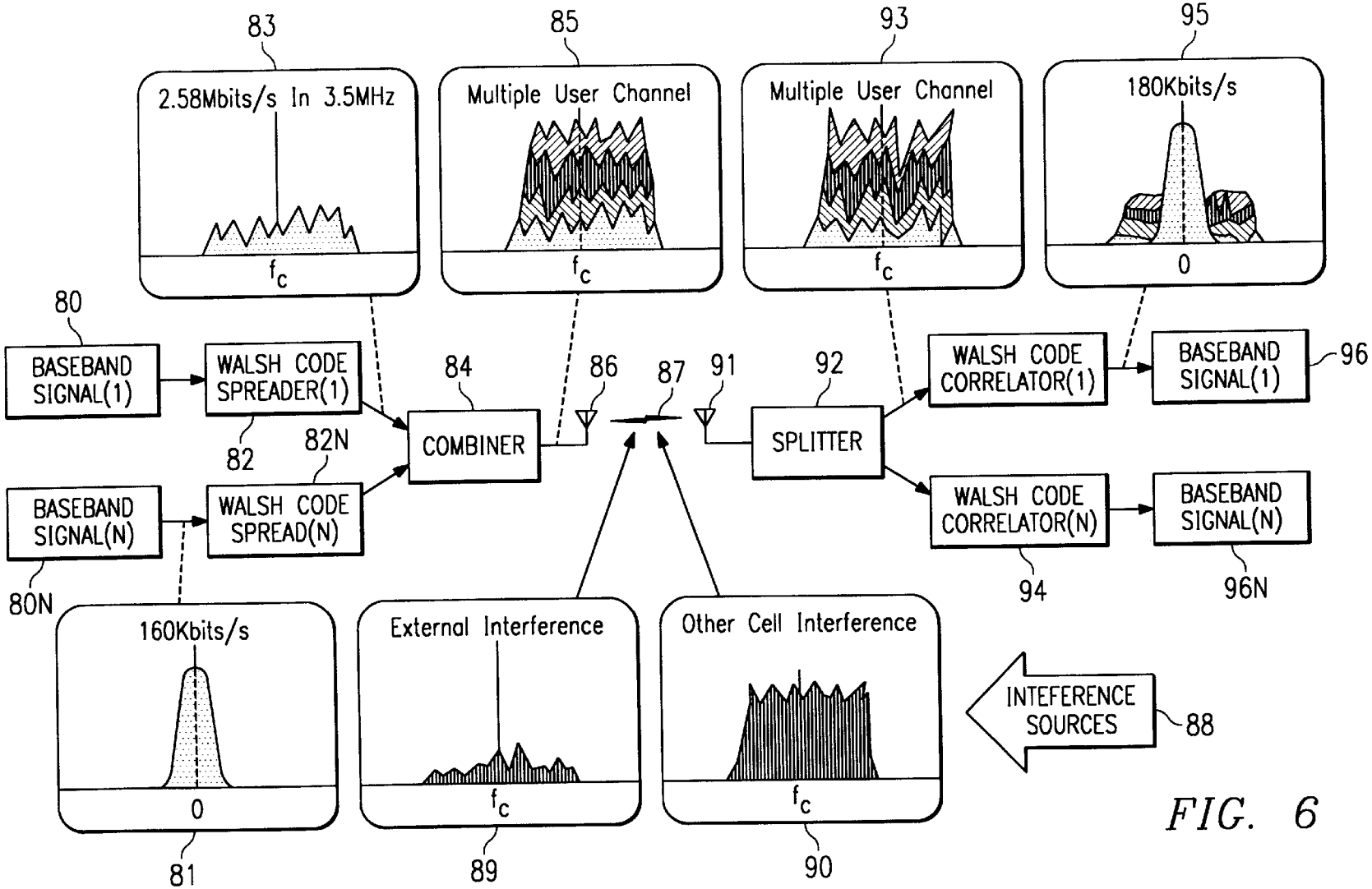
FIG. 6 is a schematic diagram illustrating aspects of a code division multiplex system for the telecommunications system of FIG. 1.

As mentioned above, each channel frequency can support 15 subscriber links. In this example, this is achieved using by multiplexing signals using a Code Division Multiplexed Access (CDMA) technique. FIG. 6 gives a schematic overview of CDMA encoding and decoding.

In order to encode a CDMA signal, base band signals, for example the user signals for each respective subscriber link, are encoded at 80–80N into a 160 ksymbols/sec baseband signal where each symbol represents 2 data bits (see, for example the signal represented at 81). This signal is then spread by a factor of 16 using a respective Walsh pseudo random noise (PN) code spreading function 82–82N to generate signals at an effective chip rate of 2.56Msymbols/sec in 3.5 MHz. The signals for respective subscriber links are then combined and converted to radio frequency (RF) to give multiple user channel signals (e.g., 85) for transmission from the transmitting antenna 86.

During transmission, a transmitted signal will be subjected to interference sources 88, including external interference 89 and interference from other channels 90. Accordingly, by the time the CDMA signal is received at the receiving antenna 91, the multiple user channel signals may be distorted as is represented at 93.

In order to decode the signals for a given subscriber link from the received multiple user channel, a Walsh correlator 94–94N uses the same pseudo random noise (PN) code that was used for the encoding for each subscriber link to extract a signal (e.g, as represented at 95) for the respective received baseband signal 96–96N. It will be noted that the received signal will include some residual noise. However, unwanted noise can be removed using a low pass filter.

The key to CDMA is the application of orthogonal codes that allow the multiple user signals to be transmitted and received on the same frequency at the same time. To avoid the noise floor rising during spreading of the signals using PN codes as the number of user signals increases, Rademacher-Walsh codes are used to encode the spread user signals. Once the bit stream is orthogonally isolated using the Walsh codes, the signals for respective subscriber links do not interfere with each other.

Walsh codes are a mathematical set of sequences that have the function of "orthonormality". In other words, if any Walsh code is multiplied by any other Walsh code, the results are zero.

The following example will illustrate this using a four bit spreading code for ease of illustration, rather than the 16 bit spreading code preferred in practice.

| Incoming User Bit Stream | PN Code Spreading (×4) | Application of Walsh Codes | | Transmit Code |
|---|---|---|---|---|
| "1" | 1011 | 0000 | 0000 | |
| "0" | 1010 | 1100 | 1000 | |
| | | | | 0010 |
| "1" | 0110 | 1010 | 0100 | |
| "1" | 0111 | 1001 | 1110 | |

Figure 7:
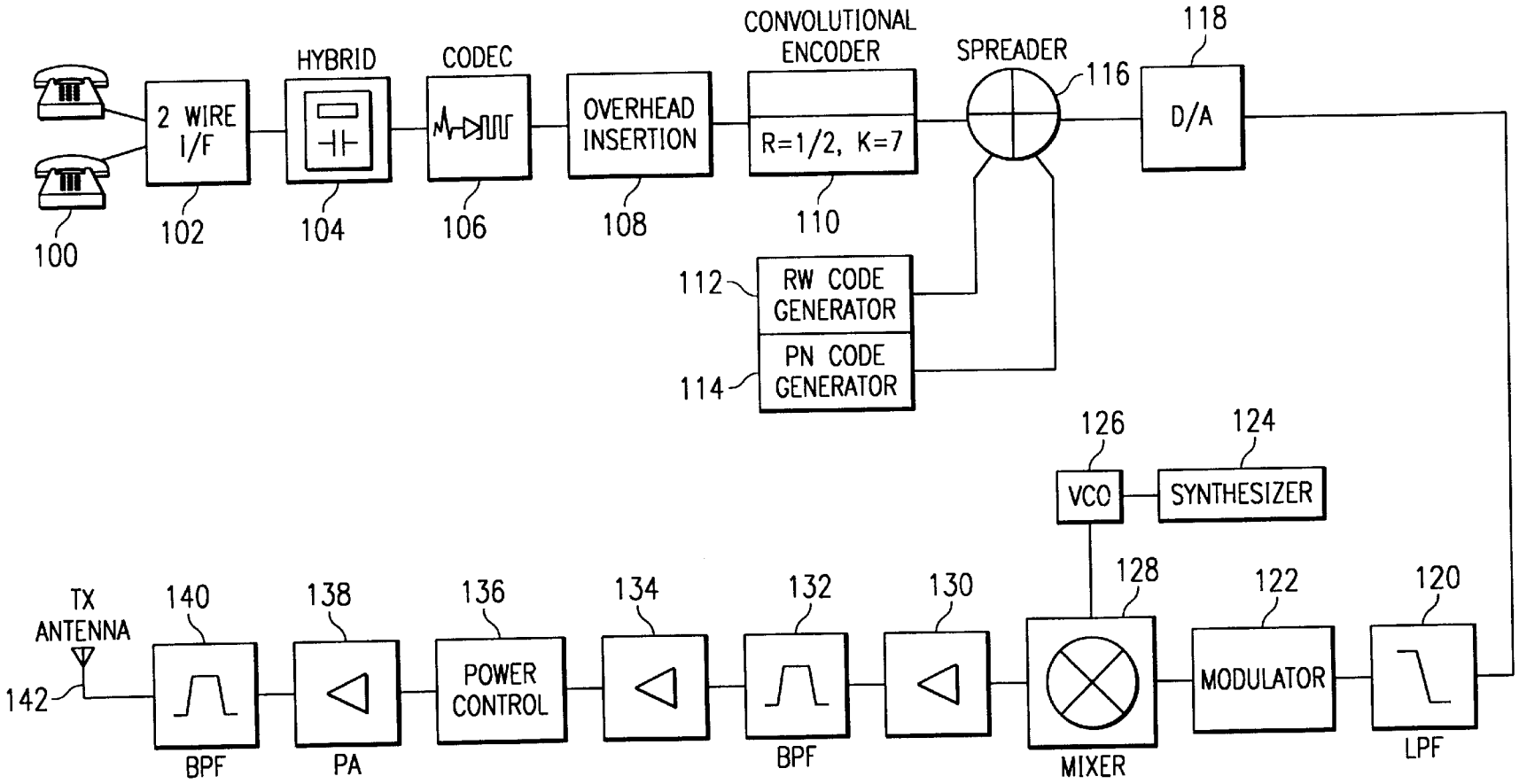
FIG. 7 is a schematic diagram illustrating signal transmission processing stages for the telecommunications system of FIG. 1.

FIG. 7 is a schematic diagram illustrating signal transmission processing stages as configured in a subscriber terminal 20 in the telecommunications system of FIG. 1. The central terminal is also configured to perform equivalent signal transmission processing. In FIG. 7, an analogue signal from one of a pair of telephones is passed via a two-wire interface 102 to a hybrid audio processing circuit 104 and then via a codec 106 to produce a digital signal into which an overhead channel including control information is inserted at 108. The resulting signal is processed by a convolutional encoder 110 before being passed to a spreader 116 to which the Radermacher-Walsh and PN codes are applied by a RW code generator 112 and PN Code generator 114, respectively. The resulting signals are passed via a digital to analogue converter 118. The digital to analogue converter 118 shapes the digital samples into an analogue waveform and provides a stage of baseband power control. The signals are then passed to a low pass filter 120 to be modulated in a modulator 122. The modulated signal from the modulator 122 is mixed with a signal generated by a voltage controlled oscillator 126 which is responsive to a synthesizer 160. The output of the mixer 128 is then amplified in a low noise amplifier 130 before being passed via a band pass filter 132. The output of the band pass filter 132 is further amplified in a further low noise amplifier 134, before being passed to power control circuitry 136. The output of the power control circuitry is further amplified in a further low noise amplifier 138 before being passed via a further band pass filter 140 and transmitted from the transmission antenna 142.

Figure 8:
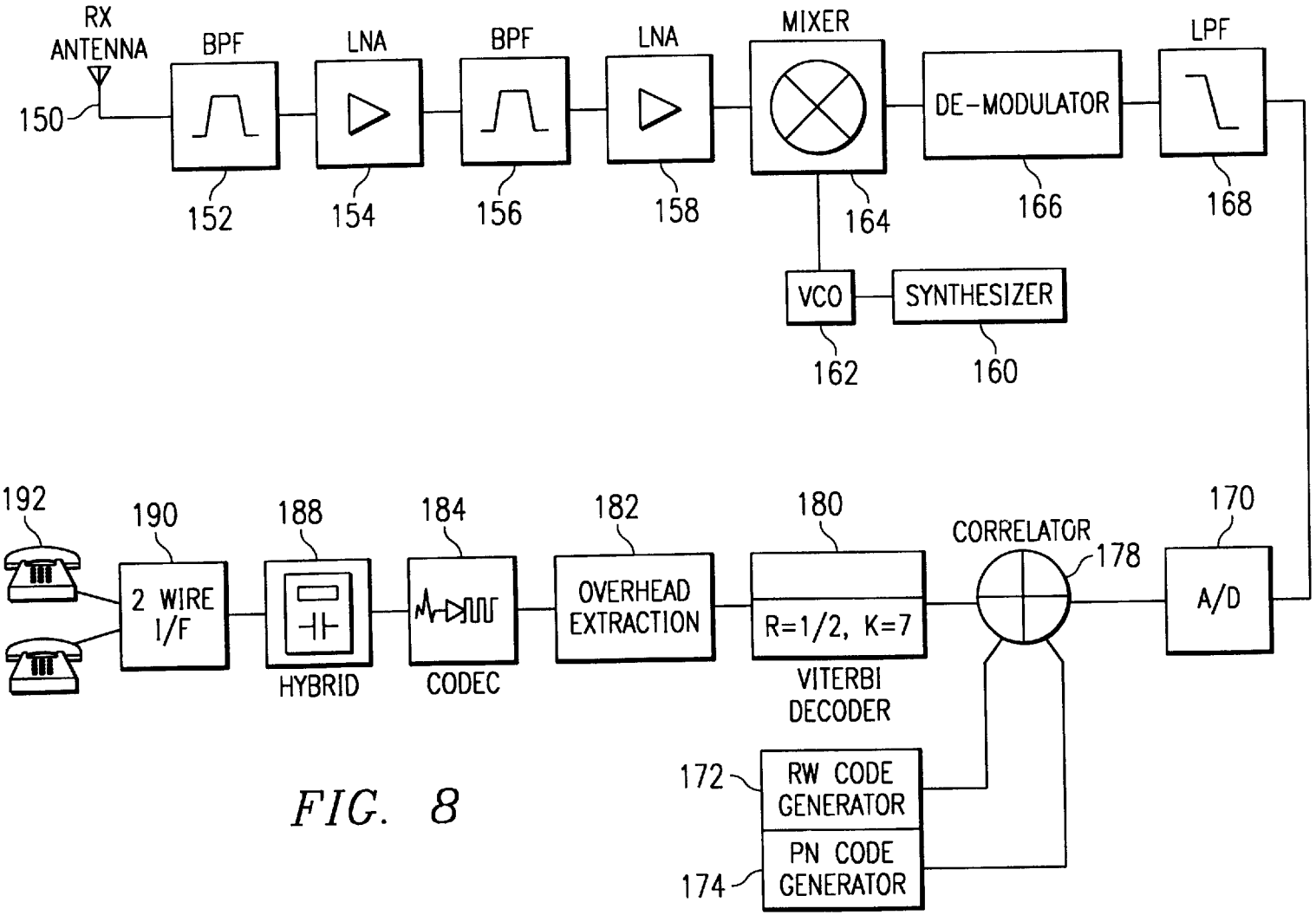
FIG. 8 is a schematic diagram illustrating signal reception processing stages for the telecommunications system of FIG. 1.

FIG. 8 is a schematic diagram illustrating the equivalent signal reception processing stages as configured in a subscriber terminal 20 in the telecommunications system of FIG. 1. The central terminal is also configured to perform equivalent signal reception processing. In FIG. 8, signals received at a receiving antenna 150 are passed via a band pass filter 152 before being amplified in a low noise amplifier 154. The output of the amplifier 154 is then passed via a further band pass filter 156 before being further amplified by a further low noise amplifier 158. The output of the amplifier 158 is then passed to a mixer 164 where it is mixed with a signal generated by a voltage controlled oscillator 162 which is responsive to a synthesizer 160. The output of the mixer 164 is then passed via the de-modulator 166 and a low pass filter 168 before being passed to an analogue to digital converter 170. The digital output of the A/D converter 170 is then passed to a correlator 178, to which the same Radermacher-Walsh and PN codes used during transmission are applied by a RW code generator 172 (corresponding to the RW code generator 112) and a PN code generator 174 (corresponding to PN code generator 114), respectively. The output of the correlator is applied to a Viterbi decoder 180. The output of the Viterbi decoder 180 is then passed to an overhead extractor 182 for extracting the overhead channel information. The output of the overhead extractor 182 is then passed via a codec 184 and a hybrid circuit 188 to a two wire interface 190 where the resulting analogue signals are passed to a selected telephone 192.

Figure 9:
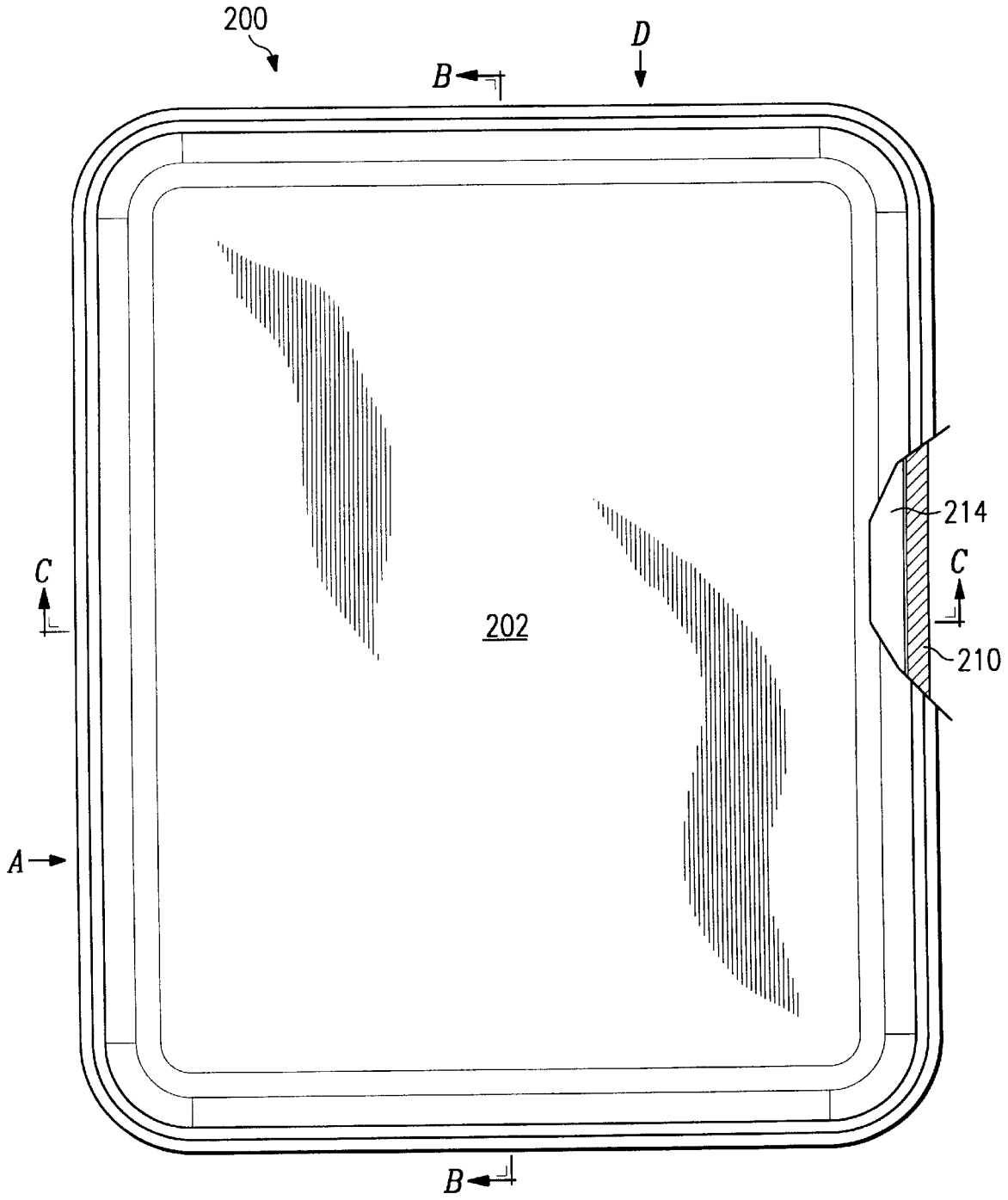
FIG. 9 is a front view of an integrated antenna for forming a customer radio unit for the subscriber terminal of FIG. 2.

FIG. 9 is a front view of an integrated antenna unit 200 forming a customer radio unit 24 in the subscriber terminal 20 of FIG. 2. A substantially rectangular radome forms the front of the antenna unit and has a substantially flat front face, which will typically be mounted with the plane of the front face substantially vertical, and a rearwardly extending peripheral wall. FIG. 9 illustrates a part of the front of the radome removed to shown a seal 210 for sealing the radome 202 to a rear cover 214. This constructions provides for a minimum of external components, facilitating the weather-proofing of the unit. The radome is preferably made of a rigid, UV and relatively fire resistant plastics material (e.g. and ABS material such as Terblend (TM) manufactured by BASF) which is transparent to radio waves. The rear cover can be made of a similar plastics material or of metal (e.g. cast metal such as an aluminum alloy) or a combination of both.

Figure 10:
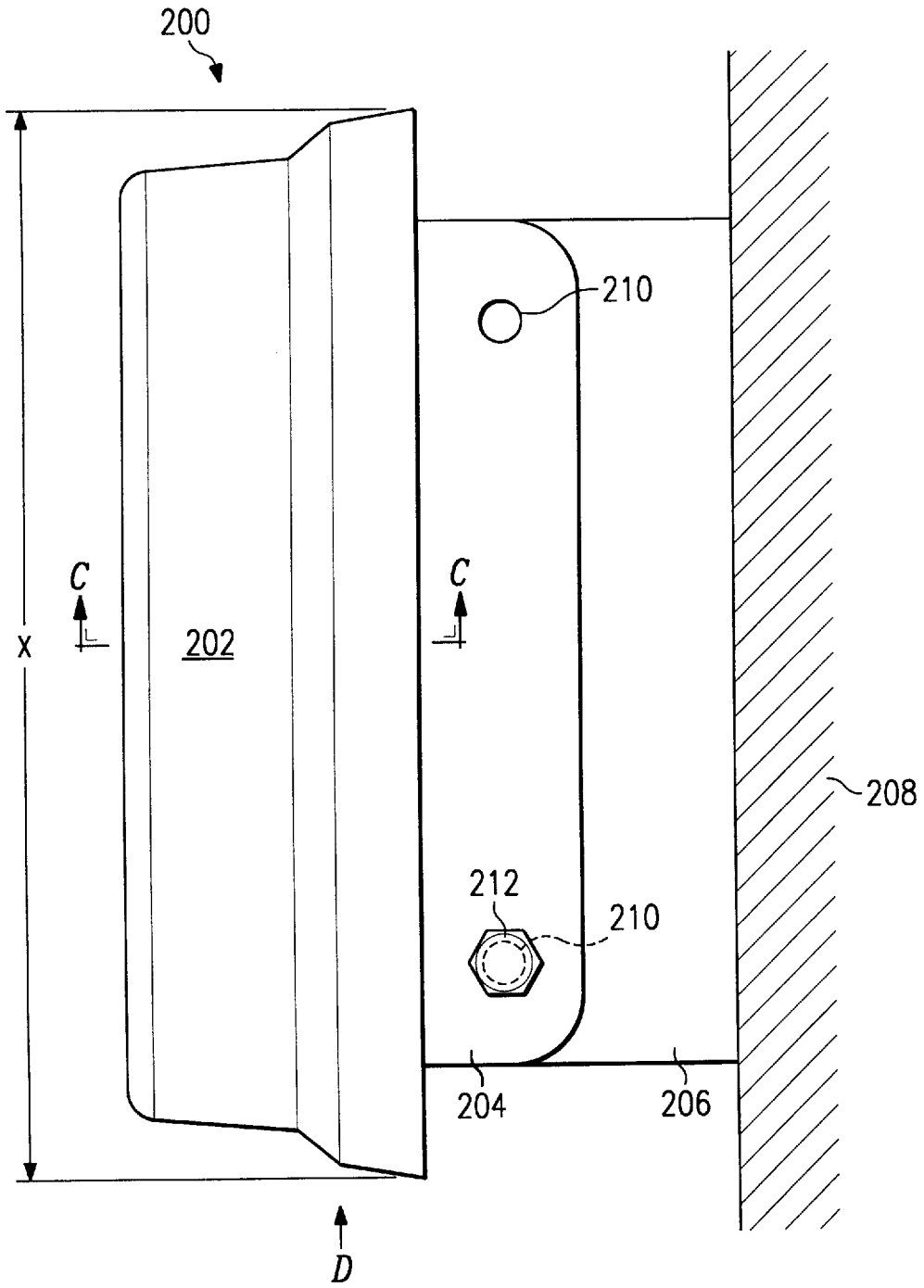
FIG. 10 is a plan view of a first example of an integrated antenna from the direction A shown in FIG. 9.

FIG. 10 is a plan view of a first example of an integrated antenna from the direction A in FIG. 9. X represents a typical total width of the antenna unit of 300 mm.

An antenna mounting bracket 204 can be seen to the rear of the radome 202 in FIG. 10. In this embodiment the rear cover is received within the rearwardly extending wall of the radome and accordingly does not appear in the Figure. However, the antenna mounting bracket is typically formed integrally with, or is secured to the rear cover, rather than being secured to the radome. The antenna mounting bracket can be substantially 'U'-shaped, wherein FIG. 10 shows the upper limb of the 'U'.

Two mounting positions (e.g., bores 210) are provided at either side of the antenna mounting bracket for attaching the antenna mounting bracket to a further mounting bracket 206 configured to cooperate with the antenna mounting bracket and to be secured to a wall 208 or to another fixed structure (e.g., a mast). The two brackets can be secured together using a bolt 212 and nut (not shown), with locking washers, etc. as required, to provide a secure fixing. By providing mounting bores 210 at either side of the rear cover of the antenna, a particularly compact mounting of the antenna to a wall or other structure can be provided. In particular, the antenna mounting bracket 204 can be mounted at a selected one of the two mounting bores 210 for selecting an appropriate pivot point for rotating said antenna to a selected side, thereby to provide a high angular range of mounting positions of said antenna with respect to the fixed support. This enables the antenna unit 200 to be mounted in an unobtrusive manner close to the wall 208 while still allowing it to be swivelled through substantially 180° so that the antenna can be pointed towards the central terminal for establishing a radio link.

The mounting brackets can be made of a suitable metal, for example a cast aluminium alloy.

Figure 11:
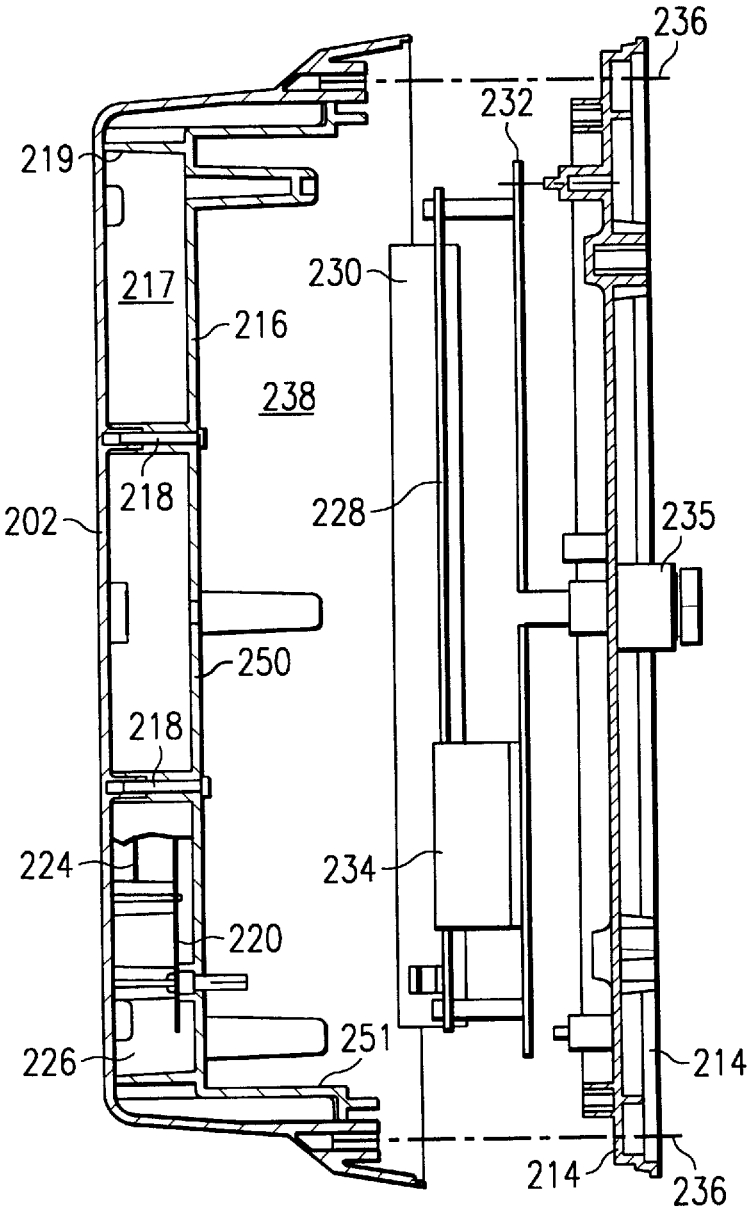
FIG. 11 is an exploded section of the integrated antenna of FIG. 10, taken along line B—B adjacent the horizontal axis of the antenna and viewed in the direction A shown in FIG. 9.

FIG. 11 is an exploded section of the integrated antenna of FIG. 10, taken along line 11—11 adjacent the horizontal axis of the antenna and viewed in the direction A shown in FIG. 9.

FIG. 11 illustrates a chassis member 250 located within the radome 202. A vertically extending wall 216 of the chassis defines a rear wall for first and second resonant cavities 226 defined to the front of the wall 216. The rear wall 216, in combination with a peripheral, forwardly extending wall 219 and a horizontal, forwardly extending wall 217 define upper and lower dished, resonant cavities above and below, respectively, the horizontal wall 217.

The chassis member is preferably made of the same plastics material as the radome, although other plastics or other materials could be used. The forwardly facing surface of the vertically extending wall 216, the inwardly facing surfaces of the peripheral wall 219 and both sides of the horizontally extending wall 217 are preferably metallised, for example with a deposited layer of aluminum or an aluminum alloy for reflecting radio waves to define the resonant cavities.

Part of the horizontal wall 217 is cut away in the lower part of the Figure to show part of a microstrip radiator element 220 and patch re-radiator (reflector) 224. A stud 222 extends from the microstrip 220 and through the wall 216 to couple radio energy though the wall 216. The radiator element construction will be described in more detail below.

The chassis member 250 also has a rearwardly extending peripheral wall 251 for defining a rear cavity 238 for containing electronic components on one or more printed circuit boards. In FIG. 11, an RF board 228 having radio frequency circuitry 230 is provided which, when inserted in cavity 238, cooperates with the stud 222 on the microstrip 220. Also shown is a modem board 232 having modem circuitry for processing received signals from and for providing transmission signals to the RF circuitry 230. The modem circuitry 234 is then connected via a drop cable (not shown) which passes through the gland 235 in the rear cover 214 to the power supply unit 30 shown in FIG. 2.

The rear side of the wall 216 and the insides of the peripheral wall 251, as well as the inside of the rear cover 214, can be metallised to provide electromagnetic shielding for the electronic components in the rear cavity 238.

The rear cover 214 is secured to the radome by screws located at 236. In this embodiment of the invention, the chassis member 250 is secured to the radome by screws 218. However, in alternative embodiments of the invention, the chassis member, the radome and the rear cover, along with the other components of the antenna unit, can be configured such that screwing on the rear cover sandwiches all of the internal components in their desired position, thus reducing the number of stages in the manufacturing process and reducing manufacturing costs.

Figure 12:
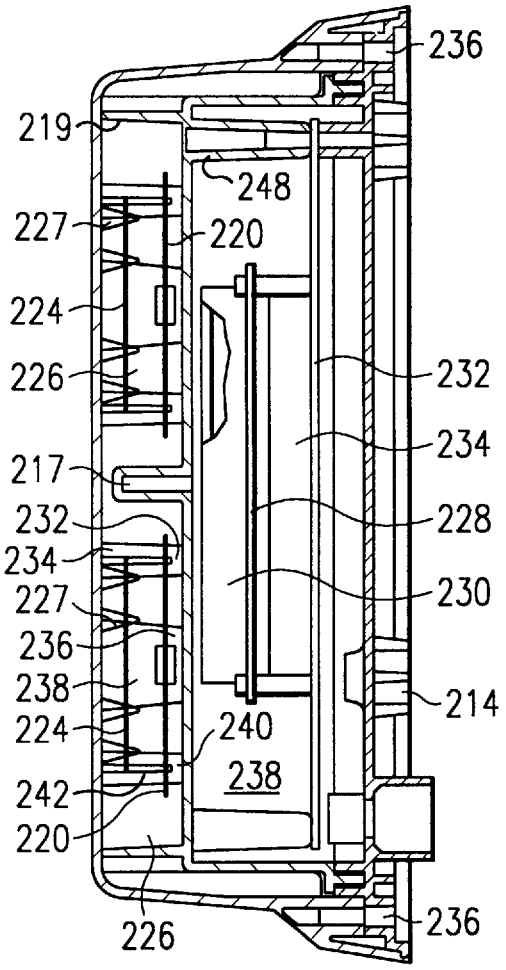
FIG. 12 is a section through the vertical axis of the integrated antenna along the line C—C and in the direction D shown in FIGS. 9 and 10.

FIG. 12 is a section through the vertical axis of the integrated antenna of FIG. 10 along the line 12—12 and in the direction D shown in FIGS. 9 and 10. FIG. 12 shows the antenna unit when assembled with the internal units of the antenna sandwiched between the radome 202 and the rear cover 214. In this Figure the horizontal wall 217 separating the upper and lower resonant cavities can be seen. Within each cavity a microstrip radiator element 220 and two patch reflectors 224 are shown. The patch reflector elements, which can be made, for example, from aluminum or aluminum alloy or the like, are secured on posts 227 on the inside of the radome 202 (e.g., by ultrasonic welding). The microstrip elements 220 are clamped between formations 232, 236 and 240 on the chassis member 250 and cooperating formations 234, 238 and 242, respectively, on the radome during assembly of the antenna unit.

Figure 13:
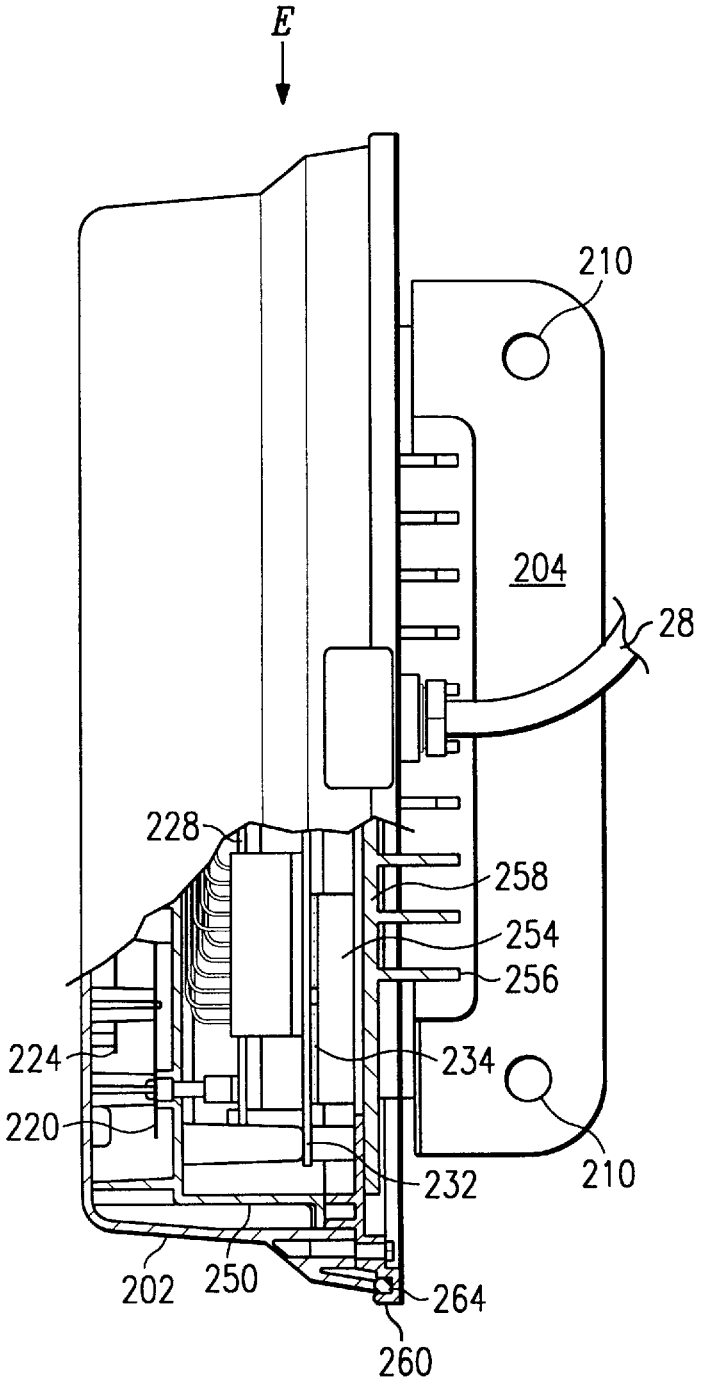
FIG. 13 is a plan view, partially in section of a second embodiment of an integrated antenna.
Figure 14:
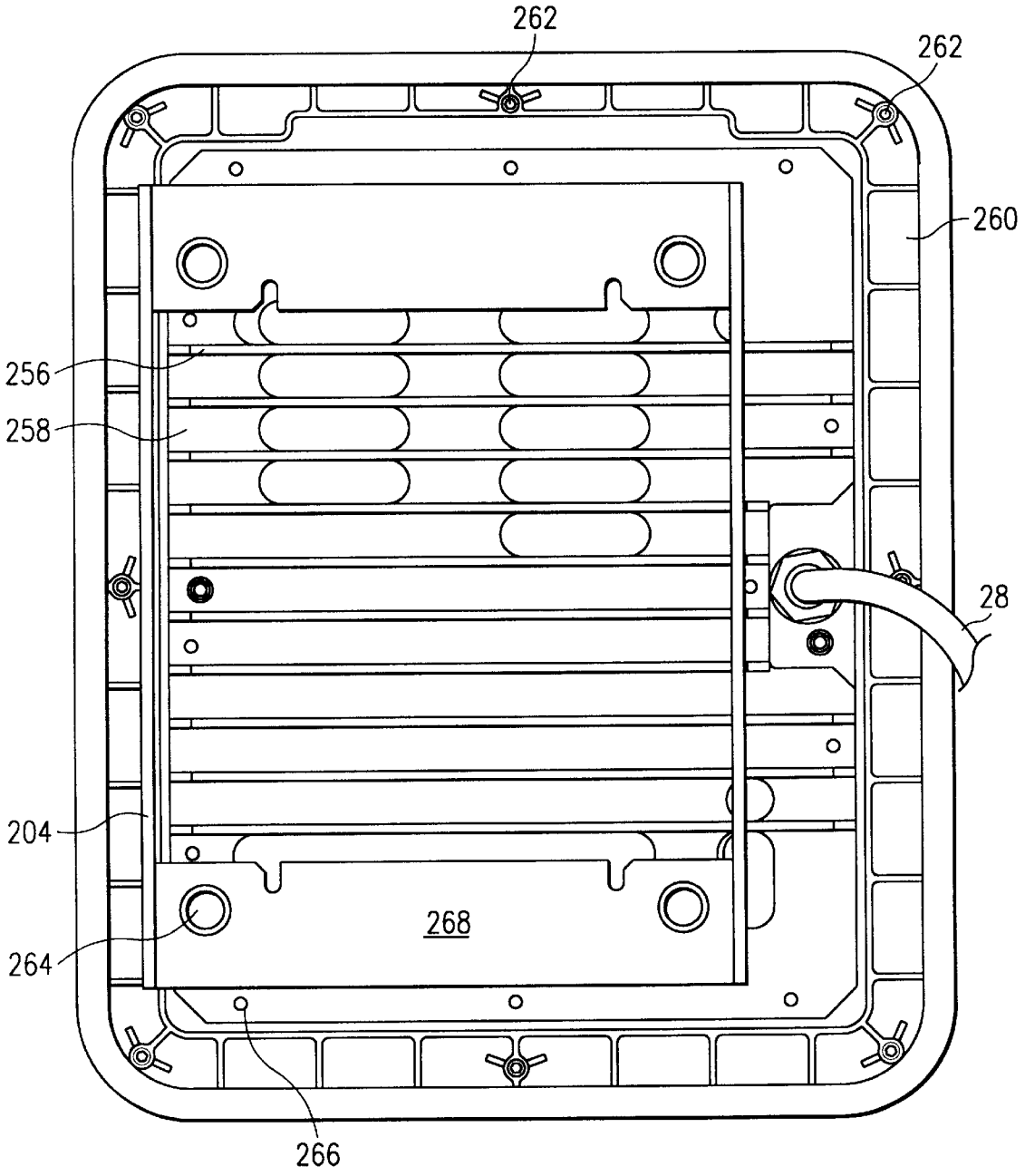
FIG. 14 is a rear view of the antenna of FIG. 13.
Figure 15:
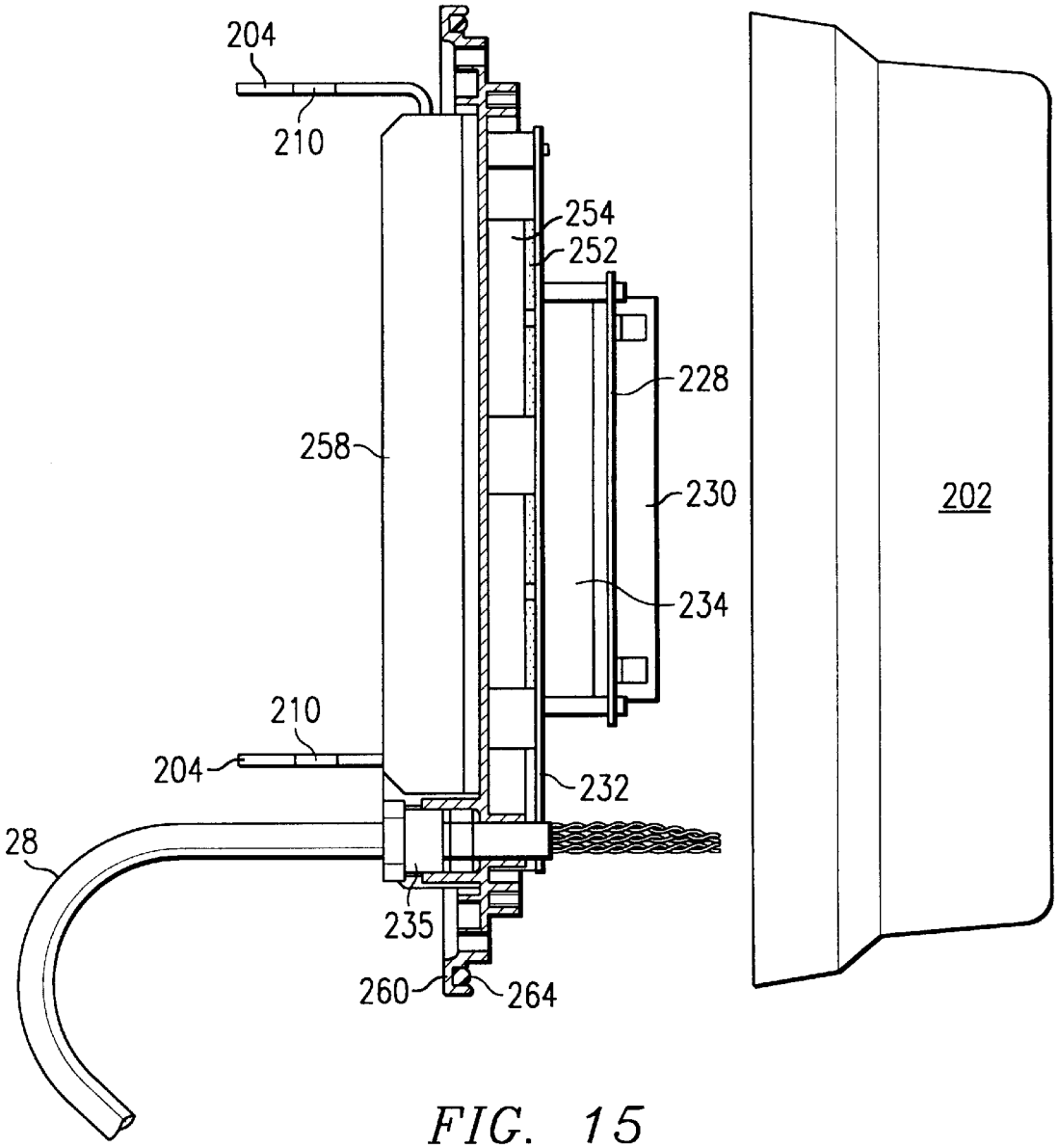
FIG. 15 is an exploded side view in the direction E of the antenna of FIG. 13.

A second embodiment of the invention will now be described with reference to FIGS. 13 to 15. FIG. 13 is a plan view, partially in section of the second embodiment of an integrated antenna. FIG. 14 is a rear view of the antenna of FIG. 13. FIG. 15 is an exploded side view of the second embodiment in the direction E shown in FIG. 13.

This second embodiment is substantially similar to the previous embodiment so that only the differences will be explained. In this embodiment the screws 218 are dispensed with, the internal components of the antenna unit being held in place by being sandwiched in position on screwing the rear cover in place.

However, the main difference between the embodiments is the use of a rear cover having a peripheral portion 260 of plastics material and a central portion 258 formed of aluminum alloy with integral fins 256 to form an integral heat sink. The provision of a heat sink enables heat to be dissipated from electronic components sealed within the integrated antenna units. A bracket 204 is secured to the heatsink by screws 264 (see FIG. 14) although it could be formed integrally withe the aluminum portion 258 of the rear cover. FIG. 13 shows an 'O'-ring seal 264 for sealing the rear cover 260 to the radome when the cover is secured thereto by screws 262. The aluminum portion 258 can be screwed at locations 266 to the peripheral plastics portion and sealed using conventional silicon sealant materials. The inside of the plastics portion 260 of the cover preferably has an aluminum coating to reduce electromagnetic interference.

In an alternative embodiment, the whole of the rear cover could be made of metal, for example, a cast aluminum alloy including the heat sink fins 256 and possibly the bracket 204.

To increase the heat transfer from the electronic components to the heatsink, the heatsink can be provided with internal pedestals 254 for contacting the circuits, or the circuit boards, directly. Alternatively, or in addition, heat conductive foam 252 can be used to couple the heat from the electronic components to the heat sink. This embodiment is particularly advantageous where a lot of heat is generated from the electronic components or when the antenna is used in warm environments, in order to avoid overheating of the components within the sealed unit.

Figure 16:
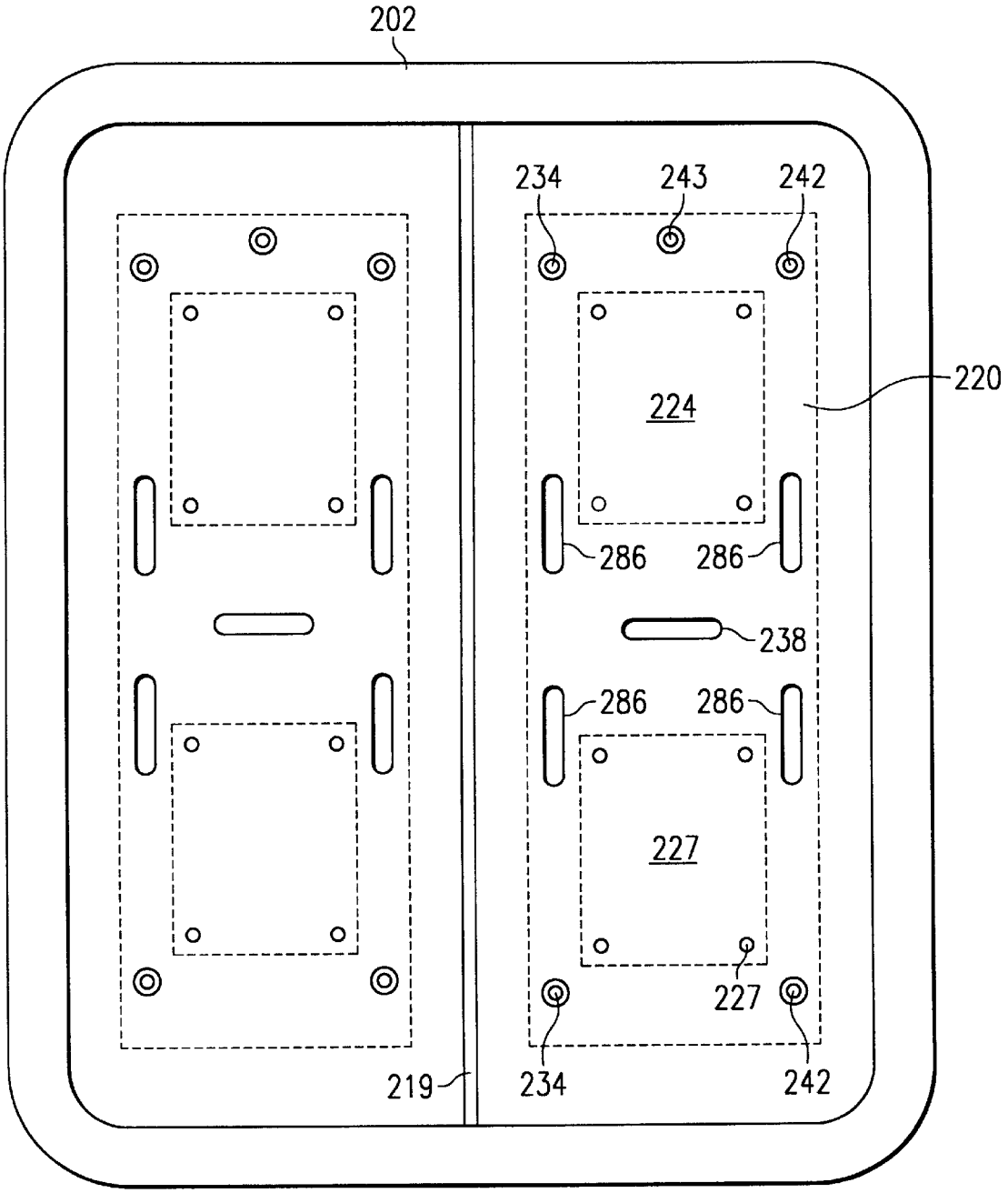
FIG. 16 is a schematic representation of the inside of a radome for an integrated antenna according to FIGS. 9 to 15.

FIG. 16 is a schematic representation of the inside of a radome for an integrated antenna according to FIGS. 9 to 15. FIG. 11 shows the position where the horizontal wall 217 of the chassis member separates the antenna area into transmit and receive cavities.

In each cavity a microstrip radiator 220 (shown hatched) is located on locating and clamping formations 236, 238 and 242 formed within the radome. The formations 234 and 242 are in the form of pillars with a flat top and, in the middle of the flat top, a pin shaped portion for cooperating with a corresponding hole in a microstrip. A similar pillar 243 can also be provided at the position where the stud 222 is located in order to support the stud during assembly of the antenna unit. Formations 238, and similar formations 286 are formed as supporting walls.

In each cavity two patches 224 (also shown hatched) are secured by ultrasonic welding or the like on the top of posts 227 so that they are located between the microstrip and the radome at a spacing from the ground plane of the microstrip to maximize the Q factor for the radiator. The size and spacing required for the patch re-radiators 224 is calculated in order to give a desired gain for a desired frequency in accordance with conventional calculation techniques.

For example, in one specific example of an integrated antenna for use with the frequencies described with reference to FIG. 4, both the transmit and receive cavities are 238 mm long by 188 mm wide. Both the transmit and receive microstrip boards are 203 mm long by 73 mm wide and 0.5 mm thick. Both of the transmit patches are 50 mm by 51 mm and both of the receive patches is 50 m by 49 mm. Each patch is located 8.2 mm from the ground plane of the respective microstrips and the microstrips are spaced by 7.7 mm from the chassis wall 216 forming the rear of the cavities 226. It will be appreciated that these dimensions are given by way of example only, and that dimensions of the components for any particular embodiment will depend on the frequency characteristics of the transmit and receive signals required.

Figure 17:
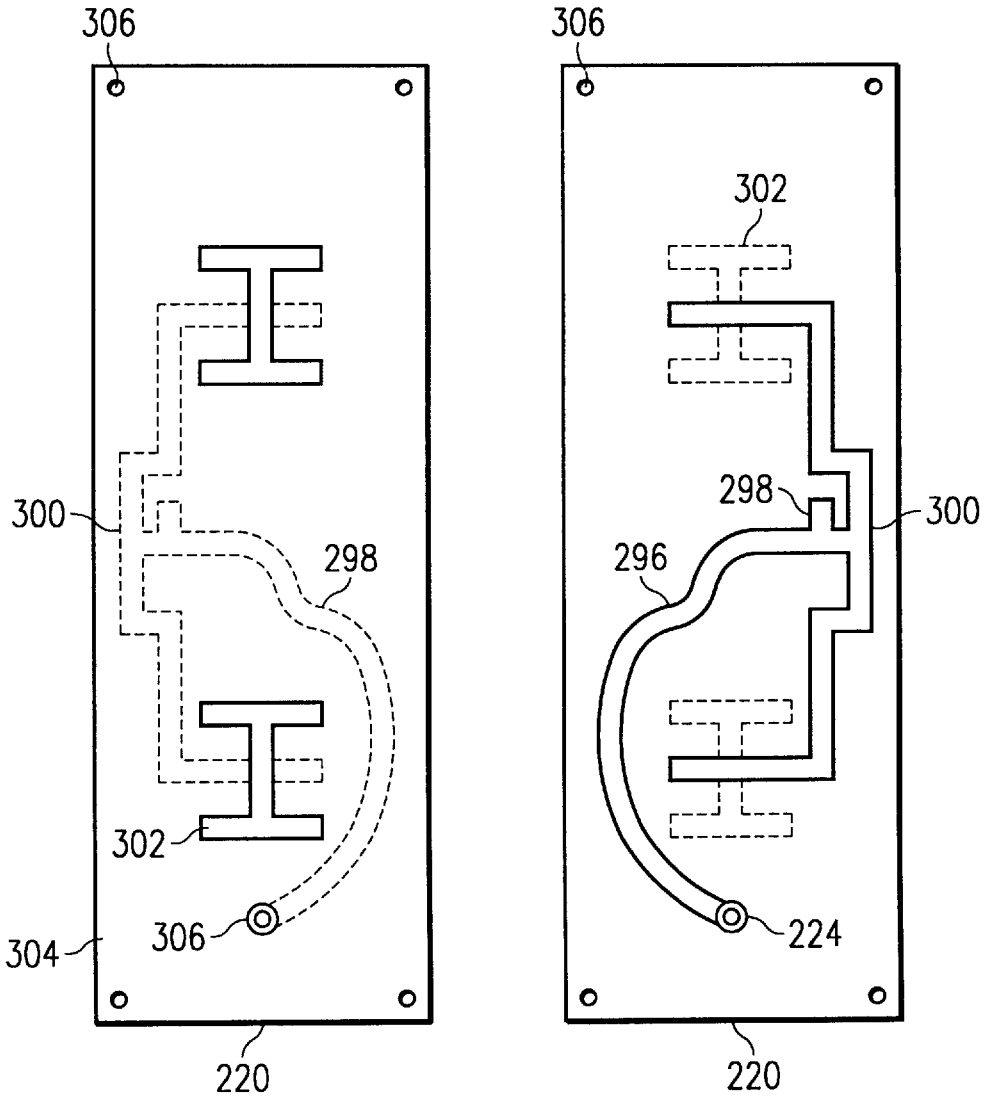
FIG. 17 is a schematic representation of the two sides of a microstrip.

FIG. 17 is a schematic representation of the two sides of a microstrip radiator. Side A represents the ground plane side of the microstrip, which in use will face backwards, that is away from the re-radiator patches and towards the rear wall of the chassis member showing two 'H'-shaped coupling slots 302 in solid lines. It should be noted that other shapes could be used for the dipole coupling slots. Many alternative shapes are known, for example dumbbells. It should be appreciated that the coupling slots are formed by openings in the ground plane layer on the microstrip. Typically they do not form slots which extend though the substrate onto which the ground plane is formed. The holes 306 form holes in the microstrip substrate for cooperating with the pins on the posts 242 formed on the inside of the radome.

Also shown in hatched lines in FIG. 17 are the elements on the other side of the microstrip 220. In particular, the stud 222 is connected via a long line RF feeder 296 to an RF feeder strip 300 to the location of the coupling slot 302. A tuning stub 298 can be provide for fine phase tuning of the radiator. This is useful, for example, where the same dimensions are used for the transmit and receive radiators. In this case, because of the difference in the transmit and receive frequencies, (see FIG. 4) the individual microstrips can be fine tuned to optimise the 'Q'-factor of the antenna for the particular frequency used.

Although a particular embodiment has been described herein, it will be appreciated that the invention is not limited thereto and that many modifications and additions thereto may be made within the scope of the invention.

What is claimed is:

1. An integrated directional antenna comprising:

a radome, means defining a first resonant cavity within said radome, means for defining a second resonant cavity within said radome wherein each of said first and second resonant cavities include a microstrip radiator and a patch re-radiator to provide a directed beam.

2. An antenna according to claim 1, wherein said means defining said first and second resonant cavities comprise a reflective rear wall substantially parallel to said microstrip radiator and side walls around said microstrip radiator.

3. An antenna according to claim 1, wherein said radome is provided with means for locating each patch re-radiator a predetermined distance in front of a ground plane of each microstrip radiator.

4. An antenna according to claim 1, wherein the first resonant cavity is for signal transmission and the second resonant cavity is for signal reception.

5. An antenna according to claim 1, further comprising a chassis member locatable within said radome, said chassis member having a rear wall with a rim projecting forwards from said wall to define a dished cavity.

6. An antenna according to claim 5, wherein said chassis member is made of plastics material with a metallised layer within said dished cavity for forming said resonant cavity.

7. An antenna according to claim 5, wherein said radome and said chassis member are provided with formations permitting the selective location of alternative microstrip/patch combinations for accommodating different frequencies.

8. An antenna according to claim 5, wherein said radome and said chassis member are provided with cooperating features for locating a said microstrip radiator at a predetermined distance in front of said rear wall.

9. An antenna according to claim 5, wherein said chassis member and said radome includes a central wall for providing separate transmitter and receiver cavities.

10. An antenna according to claim 5, wherein said chassis member has a further rim projecting rearwardly from said rear wall to define a rear cavity.

11. An antenna according to claim 10, wherein said chassis member is made of plastics material with a metallised layer within said rear cavity for electromagnetically shielding electronic components within said rear cavity.

12. An antenna according to claim 10, further comprising a rear cover for closing said rear cavity.

13. An antenna according to claim 12, wherein said rear cover is made at least partially of plastics material with a metallised layer thereon.

14. An antenna according to claim 12, wherein said rear cover is made at least partially of cast metal.

15. An antenna according to claim 14, wherein said rear cover incorporates and integral heat sink for dissipating heat from electronic components within said rear cavity.

16. An antenna according to claim 15, further comprising electronic circuit components within said rear cavity, and means for thermally coupling said electronic components to said heat sink.

17. An antenna according to claim 16, wherein said thermal coupling means comprises thermally conducting foam.

18. An antenna according to claim 17, further comprising pedestals for thermally coupling said electronic components to said heatsink.

19. An antenna according to claim 12, wherein said rear cover comprises an integral antenna mounting bracket.

20. An antenna according to claim 5, further comprising a rear cover and fixing means for said rear cover, said radome, said rear cover, and said chassis member being configured such that fixing of said rear cover sandwiches the component parts of said antenna in a fixed spatial relationship within said radome.

21. An antenna according to claim 1, further comprising an antenna mounting bracket.

22. An antenna according to claim 21, wherein said antenna mounting bracket comprises first and second spaced mounting points, said mounting bracket being arranged to cooperate with a further mounting bracket for connection to a fixed support, said further mounting bracket being arranged to support said antenna mounting bracket at a selected one of said first and second mounting points for selecting a pivot point for rotating said antenna at a selected side of said antenna, thereby to provide a high angular range of mounting positions of said antenna to said fixed support.

23. An integrated directional antenna comprising:

a radome, means defining a first resonant cavity within said radome, means for defining a second resonant cavity within said radome wherein each of said first and second resonant cavities include a microstrip radiator and a patch re-radiator to provide a directed beam, wherein each microstrip radiator is a compound radiator comprising a single microstrip having a ground plane on a first side of the single microstrip with first and second coupling slots in said ground plane, said coupling slots being spaced from each other, and two reflector patches, each located in front of a respective coupling slot.

24. An antenna according to claim 23, wherein each single microstrip comprises a long line RF feeder to an RF feeder strip to said two coupling slots on a second side of said single microstrip.

25. An antenna according to claim 24, wherein said single microstrip radiator within said first resonant cavity is for signal transmission and said single microstrip radiator within said second resonant cavity is for signal reception, wherein said long line RF feeder for at least one microstrip includes a tuning stub.

* * * * *